US012559940B2

(12) United States Patent
Karlsson et al.

(10) Patent No.: US 12,559,940 B2
(45) Date of Patent: Feb. 24, 2026

(54) CEILING SUSPENSION BRACKET

(71) Applicant: MITEK HOLDINGS, INC., Wilmington, DE (US)

(72) Inventors: Per Ove Karlsson, Eksj (SE); Stefan Asberg, Boxholm (SE); Bo Starby, Eksjo (SE); Peter Koski, Huskvarna (SE)

(73) Assignee: MiTek Holdings, Inc., Wilmington, DE (US)

( * ) Notice: Subject to any disclaimer, the term of this patent is extended or adjusted under 35 U.S.C. 154(b) by 228 days.

(21) Appl. No.: 18/245,262

(22) PCT Filed: Sep. 16, 2021

(86) PCT No.: PCT/US2021/050647
§ 371 (c)(1),
(2) Date: Mar. 14, 2023

(87) PCT Pub. No.: WO2022/060972
PCT Pub. Date: Mar. 24, 2022

(65) Prior Publication Data

US 2024/0018778 A1 Jan. 18, 2024

(30) Foreign Application Priority Data

Sep. 17, 2020 (SE) ..... 2051081-4

(51) Int. Cl.
*E04B 9/18* (2006.01)
*E04B 9/04* (2006.01)
*E04B 9/24* (2006.01)

(52) U.S. Cl.
CPC ..... *E04B 9/18* (2013.01); *E04B 9/04* (2013.01); *E04B 9/245* (2013.01)

(58) Field of Classification Search
CPC ... E04B 9/18; E04B 9/04; E04B 9/245; E04B 2001/389; E04B 9/24; E04B 5/02;
(Continued)

(56) References Cited

U.S. PATENT DOCUMENTS 1,415,273 A 5/1922 Stevens
1,578,964 A 3/1926 Duphiney
(Continued)

FOREIGN PATENT DOCUMENTS

CN 209227877 U 8/2019
CZ 19304 U1 2/2009
(Continued)

OTHER PUBLICATIONS

International Search Report and Written Opinion, dated Dec. 22, 2021, PCT Application No. PCT/US2021/050647, 42 pages.
(Continued)

*Primary Examiner* — Rodney Mintz
(74) *Attorney, Agent, or Firm* — Stinson LLP

(57) ABSTRACT

A bracket (1) for holding a suspended ceiling has a first end (2) for anchoring the bracket (1) to a beam or the like of a building structure and a second end (3) to which a mounting profile is attachable on which a building panel is mountable. The bracket (1) has a rectangular and flat part (4) that in use is horizontally arranged between the first and second ends (2, 3). The length (L) of the flat part (4) between the first and second ends (2, 3) is at least 1.5 times as long as the width (W) of the flat part (4).

5 Claims, 2 Drawing Sheets

(58) Field of Classification Search
CPC ..... E04B 2009/186; E04C 3/16; E04C 3/18; E04C 3/291; E04C 3/292
See application file for complete search history.

(56) References Cited

U.S. PATENT DOCUMENTS

| | | | | |
|---|---|---|---|---|
| 3,828,508 | A * | 8/1974 | Moeller | E04B 9/245 52/764 |
| 3,998,020 | A * | 12/1976 | Kuhr | E04B 9/18 52/506.07 |
| 3,998,419 | A * | 12/1976 | Semmerling | E04B 9/18 248/323 |
| 4,275,541 | A | 6/1981 | Orals et al. | |
| 4,475,328 | A | 10/1984 | Reeder et al. | |
| 5,024,034 | A * | 6/1991 | Gailey | E04B 9/247 52/509 |
| 5,119,612 | A | 6/1992 | Taylor et al. | |
| 5,397,090 | A | 3/1995 | Carson et al. | |
| 6,202,969 | B1 * | 3/2001 | Orr | E04B 9/18 248/301 |
| 7,735,285 | B2 * | 6/2010 | Payne, Jr. | E04B 9/18 248/560 |
| 10,718,113 | B2 | 7/2020 | Baxter et al. | |
| 11,821,203 | B2 * | 11/2023 | Pollenus | E04B 9/0435 |
| 2006/0005495 | A1 * | 1/2006 | Stessel | E04B 9/24 52/506.07 |
| 2006/0016138 | A1 * | 1/2006 | Blount | E04B 5/40 52/263 |
| 2008/0148667 | A1 | 6/2008 | Payne | |
| 2019/0257083 | A1 * | 8/2019 | Baxter | E04B 7/14 |
| 2022/0213685 | A1 * | 7/2022 | Pollenus | E04B 9/001 |
| 2024/0102283 | A1 * | 3/2024 | Karlsson | E04C 3/16 |

FOREIGN PATENT DOCUMENTS

| | | | |
|---|---|---|---|
| DE | 2608598 | A | 9/1977 |
| DE | 19843839 | A1 | 3/2000 |
| DE | 202021104162 | U1 | 9/2021 |
| EP | 2112294 | A1 | 10/2009 |
| EP | 2743423 | A1 | 6/2014 |
| FR | 1402519 | A | 6/1965 |
| GB | 2460627 | A | 12/2009 |
| JP | 05122431 | B2 | 1/2013 |
| KR | 20070016916 | A | 2/2007 |
| WO | 8100425 | A1 | 2/1981 |

OTHER PUBLICATIONS

Extended European Search Report, for EP Application No. 21870208.2, dated Oct. 17, 2024, 10 pages.
Extended European Search Report from EP Application No. 21887349.5, dated Aug. 9, 2024, 9 pages.
Patent Examination Report 1, New Zealand Application No. 798221, Nov. 18, 2024, 3 pages.
Patent Examination Report 2, New Zealand Application No. 798221, Feb. 4, 2025, 5 pages.
Patent Examination Report #2, New Zealand Application No. 798222, May 20, 2025, 5 pages.

* cited by examiner

CEILING SUSPENSION BRACKET

TECHNICAL FIELD

The present invention relates to a bracket for holding a suspended ceiling, wherein said bracket has a first end for anchoring the bracket to a beam or the like of a building structure, and a second end to which a mounting profile is attachable on which a building panel is mountable. The bracket has a rectangular and flat part that in use is horizontally arranged between the first and second ends.

BACKGROUND

There are various suspension solutions for ceilings available. A suspended ceiling is a secondary ceiling, hung below the main (structural) ceiling. It may also be referred to as a drop ceiling, T-bar ceiling, false ceiling, dropped ceiling, grid ceiling, drop in ceiling, drop out ceiling, or ceiling tiles and is a staple of modern construction and architecture in both residential and commercial applications. For the sake of facilitating understanding, this type of ceiling will be referred to as "suspended ceiling" throughout the disclosure.

Suspended ceilings and ceiling tiles were being used in Japan for aesthetic reasons as early as the fourteenth century. These could be made with simple planks or coffered. Blackfriars Theater in London, England, built in 1596, had suspended ceilings to aid acoustics.

Many systems for suspended ceilings are directed to be used for ceilings with sound absorbing boards. The suspension assemblies varies from bolts to brackets. More advanced types are available, for instance, comprising springs etc. to achieve acoustic benefits.

SUMMARY

It is an object of the present invention to provide an alternative bracket for a suspended ceiling. This object is achieved with a bracket as defined in the appended claims.

According to a first aspect of the present disclosure a bracket for holding a suspended ceiling that has a first end for anchoring the bracket to a beam or the like of a building structure and a second end to which a mounting profile is attachable on which a building panel is mountable. The bracket has a rectangular and flat part that in use is horizontally arranged between the first and second ends. The length of the flat part between the first and second ends is at least 1.5 times as long as the width of the flat part.

Surprisingly, the dimensions described above as relates to the bracket for a suspended ceiling have shown to improve the noise reduction.

According to a preferred aspect of the present disclosure, the length of the flat part is between 30 and 70 times the thickness of the flat part. Even more preferred is when the length of the flat part is between 40 and 50 times the thickness of the flat part.

According to another aspect of the present disclosure the second end of the bracket has the same width as the flat part and perpendicular to the plane of the flat part pointing downwards in use.

According to a further aspect of the present disclosure the first end of the bracket has a connector part arranged between the first end and an anchor part. The connector part has the same width as the flat part and perpendicular to the plane of the flat part pointing upwards in use.

According to yet another aspect of the present disclosure the anchor part is a flat rectangular part, the length of the anchor part being greater than the width of the connector part, wherein the plane of the anchor part is parallel with the plane of the flat part. The connector part is arranged centrally on one of the long sides of the anchor part, wherein the anchor part further comprising attachment means.

According to yet a further aspect of the present disclosure the attachment means are holes for screws arranged at each end of the anchor part. Thus, the bracket is easily fastened to the building structure and a beam or similar elongate carrier could be attached to the bracket without the need of switching positions upon installation.

According to a preferred aspect of the present disclosure the length of the flat part between the first and second ends is shorter than 2.5 times the width of the flat part. Even more preferred is when the length of the flat part between the first and second ends is longer than 1.6 times the width of the flat part and shorter than 1.8 times the width of the flat part.

For facilitating the production the bracket is made of a single piece of bent metal sheet.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
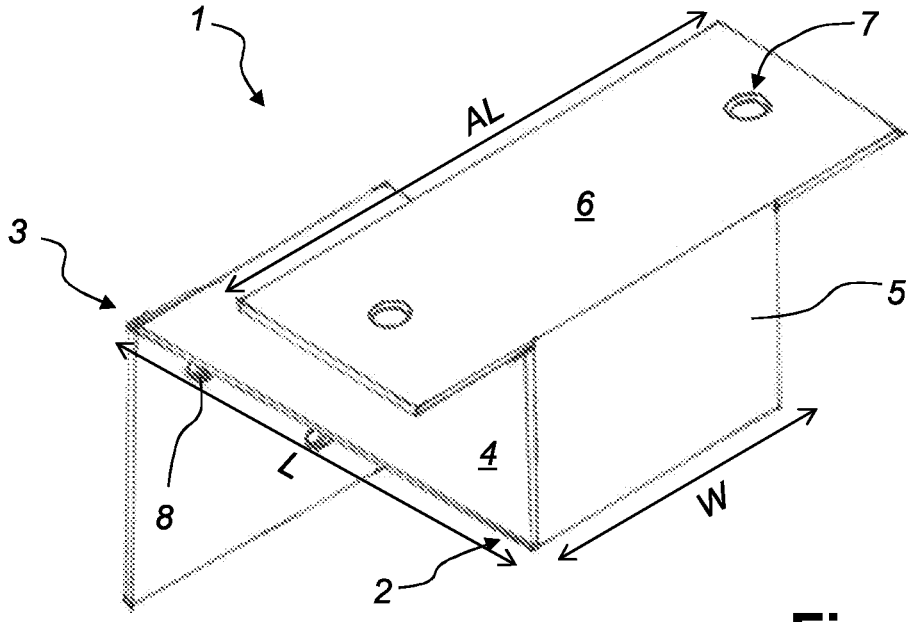
FIG. 1 is a perspective view of a bracket according to the present disclosure.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

Figure 2:
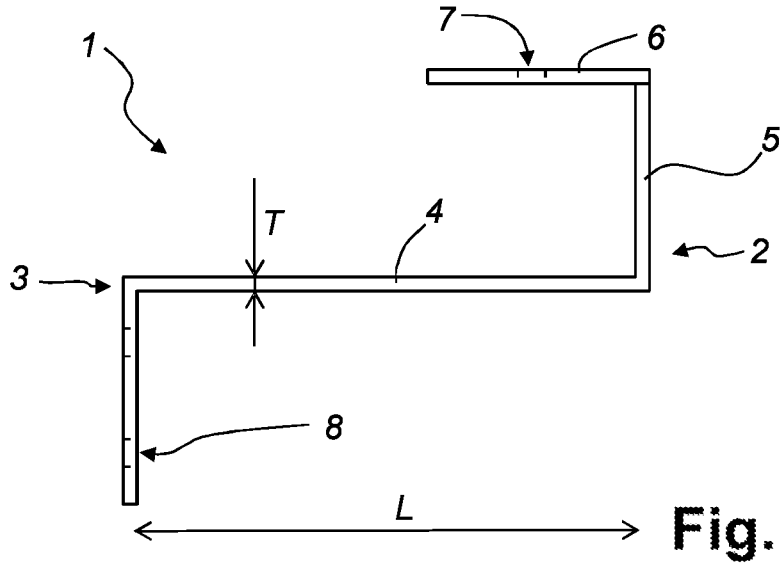
FIG. 2 is a side view of the bracket shown in FIG. 1.
Figure 3:
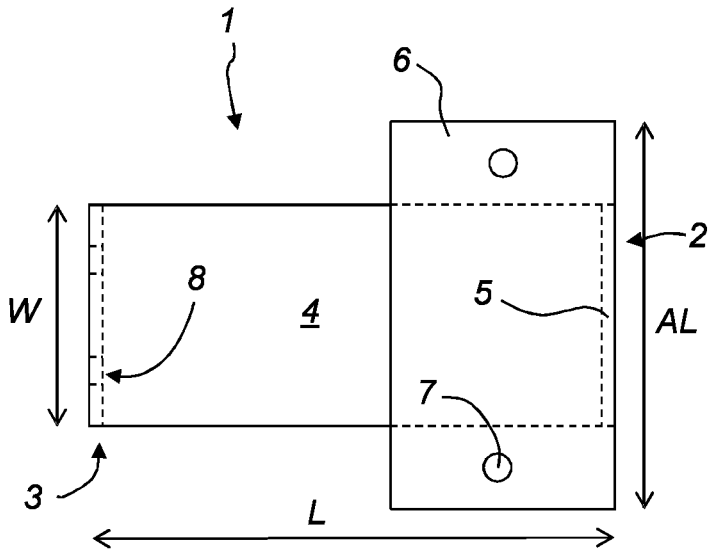
FIG. 3 is a top view of the bracket shown in FIG. 1.
Figure 4:
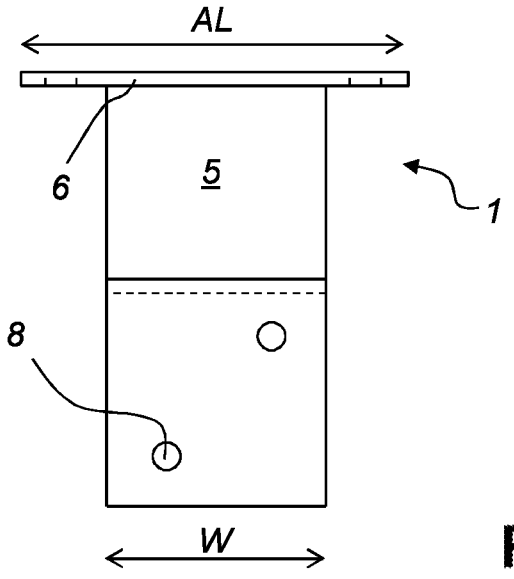
FIG. 4 is a front view of the bracket shown in FIG. 1.

With reference to FIGS. 1-4, a bracket 1 for holding a suspended ceiling is shown. The bracket 1 has a first end 2 for anchoring the bracket 1 to a beam or the like of a building structure and a second end 3 to which a mounting profile is attachable on which a building panel is mountable. The bracket 1 has a rectangular and flat part 4 horizontally arranged between the first and second ends 2, 3.

The length L of the flat part 4 between the first and second ends 2, 3 is in the shown embodiment 1.7 times as long as the width W of the flat part 4.

The length L of the flat part 4 is about 45 times the thickness T of the flat part 4.

As further can be seen in the figures, the second end 3 of the bracket 1 has the same width W as the flat part 4 and perpendicular to the plane of the flat part 4, the second end 3 pointing downwards.

Also, the first end 2 of the bracket 1 has a connector part 5 is connected to an anchor part 6. The connector part 5 has the same width W as the flat part 3 and perpendicular to the plane of the flat part 3, the connector part 5 pointing upwards.

The anchor part 6 is a flat rectangular part and the length AL of the anchor part 6 is twice the width W of the connector part 5. The plane of the anchor part 6 is parallel with the plane of the flat part 3. The connector part 3 is arranged centrally on one of the long sides of the anchor part 6. The anchor part 6 comprises attachment means 7 in the forms of apertures/holes at the ends of the anchor part (6) and outside the connector part when seen from above, see FIG. 3. As a result, this allows for easy access when for instance screwing the bracket 1 to a building structure.

Further holes 8 are provided on the second end 3 of the bracket 1 for allowing a mounting profile to be attached on which a building panel is mountable. Looking at FIG. 2, the mounting profile could be fastened on the left side of the bracket 1 such that the screws are inserted from the right side of the second end 3. Alternatively, the mounting profile could be fastened on the right side of the bracket 1 such that the screws are inserted from the left side of the second end 3.

Also, the bracket 1 is made of a single piece of bent metal sheet. For facilitating the bending of the metal sheet, smaller apertures could be cut out on the edges of the metal sheet where the folds are to be made.

It is to be understood that the present invention is not limited to the embodiments described above and illustrated in the drawings; rather, the skilled person will recognize that many changes and modifications may be made within the scope of the appended claims. For example, the length L of the flat part 4 could be between 30 and 70 times the thickness T of the flat part 4.

The invention claimed is:

1. A bracket for holding a suspended ceiling, comprising:

a first end configured to anchor the bracket to a building structure, and a second end to which a mounting profile is attachable on which a building panel is mountable, the bracket having a rectangular and flat part that extends horizontally between the first and second ends, a length of the rectangular and flat part between the first and second ends being about 1.5 times to about 2.5 times as long as a width of the rectangular and flat part, a mounting part located at the second end and extending in a first direction from the rectangular and flat part, a connector part located at the first end and extending in an opposite, second direction from the rectangular and flat part, and an anchor part extending from the connector part, wherein the mounting part of the bracket has a width equal to the width of the rectangular and flat part and extends perpendicular to a plane of the rectangular and flat part, the mounting part extending downwards in use, wherein the connector part is connected to the anchor part, the connector part having a width equal to the width of the rectangular and flat part and extending perpendicular to the plane of the rectangular and flat part, the connector part extending upwards in use, wherein the anchor part is a planar rectangular part, a length of the anchor part being greater than the width of the connector part, wherein a plane of the anchor part is parallel with the plane of the rectangular and flat part, the connector part being arranged centrally on a long side of the anchor part, the anchor part further comprising attachment means, wherein the attachment means are holes located at opposite ends of the anchor part, the holes configured to receive screws therein, wherein the mounting part is configured to be attached to the suspended ceiling.

2. The bracket according to claim 1, wherein said length of the rectangular and flat part is between 30 and 70 times a thickness of the rectangular and flat part.

3. The bracket according to claim 1, wherein said length of the rectangular and flat part is between 40 and 50 times a thickness of the rectangular and flat part.

4. The bracket according to claim 1, wherein the length of the rectangular and flat part between the first and second ends is longer than 1.6 times the width of the rectangular and flat part and shorter than 1.8 times the width of the rectangular and flat part.

5. The bracket according to claim 1, wherein the bracket is made of a single piece of bent metal sheet.

* * * * *